United States Patent [19]

Melcher et al.

[11] 4,131,476

[45] Dec. 26, 1978

[54] ADDITIVE FOR GREEN MOLDING SAND

[75] Inventors: Ronald E. Melcher; Frederick W. Schaefer, both of Madison, N.J.

[73] Assignee: Whitehead Brothers Company, Florham Park, N.J.

[21] Appl. No.: 822,265

[22] Filed: Aug. 5, 1977

[51] Int. Cl.[2] ..... B28B 7/34

[52] U.S. Cl. ..... 106/38.35; 106/38.3; 106/38.6; 106/38.9; 106/68; 106/71; 106/238

[58] Field of Search ..... 106/38.3, 38.35, 38.9, 106/68, 71, 38.6, 238

[56] References Cited

U.S. PATENT DOCUMENTS

| | | | |
|---|---|---|---|
| 2,072,212 | 3/1937 | Moosdorf et al. | 106/38.3 |
| 3,816,145 | 6/1974 | Melcher | 106/38.6 |

*Primary Examiner*—Lorenzo B. Hayes

*Attorney, Agent, or Firm*—Kenyon & Kenyon, Reilly, Carr & Chapin

[57] ABSTRACT

Salts of lithium or magnesium and an organic carboxylic acid, especially lithium acetate and/or magnesium acetate, are added to green molding sand to improve the properties of hot green molding sand at 110–160° F (43.3–71.1° C). Magnesium acetate is preferred, especially in green molding sands used for casting steel.

16 Claims, No Drawings

ADDITIVE FOR GREEN MOLDING SAND

DISCLOSURE

The present invention relates to additives for green molding sand. More particularly, this invention is concerned with additives for improving the physical properties of hot green molding sand, i.e. green molding sand at a temperature of from about 110°-160° F. (43.3°-71.1° C.).

BACKGROUND OF THE INVENTION

As is well known, the foundry art is that art dealing with the formation of metal articles by casting processes wherein molten metal is poured into a mold, allowed to cool, and solidify. By far the largest quantity of castings are made by processes in which the mold is formed from sand, i.e., by sand casting processes. There are several different sand casting processes, but the one employed most often is that employing green molding sand.

Green molding sand has been defined as a "plastic mixture of sand grains, clay, water and other materials which can be used for molding and casting processes. The sand is called 'green' because of the moisture present and is thus distinguished from dry sand." (Heine et al., "Principles of Metal Casting," McGraw-Hill Book Co., Inc., New York (1955), p. 22). Green sand has also been defined as "a naturally bonded sand or a compounded molding-sand mixture which has been tempered with water for use while still in the damp or wet condition." ("Molding Methods and Materials," 1st. Ed., The American Foundrymen's Society, Des Plaines (1962)). Such a sand contains water or moisture both in the mold-forming stage and in the metal casting phase. As employed herein, the term "foundry green molding sand" has reference to green molding sands of the type known to and employed by those of ordinary skill in the foundry art comprising molding sand and clay and tempered with water.

As is evident from the foregoing, the essential components of a foundry green molding sand are molding sand, clay and water. The molding sand, which usually is a silica sand (e.g., quartz), but which may be a zircon, olivine or other refractory particulate material having mesh sizes commonly in the range of from about 6 to about 270 mesh, serves largely as a filler and provides the body of the mold. The clay, which is a finely divided (normally less than about 2 microns) material such as montmorillonite (bentonite), illite, kaolinite, fire clay and the like, when plasticized with water, serves as a binder for the sand grains, and imparts the physical strength necessary to enable use of the green molding sand as a mold material. Ordinarily, green molding sands contain from about 5 to about 20 weight percent clay, based upon sand, and sufficient water, normally not greater than about 8 weight percent, based upon sand, to achieve the desired plasticity and other physical properties. The amount of temper water normally is greater when naturally-bonded sands are employed than when synthetic sands are employed.

There are a number of properties which are desired in foundry green molding sands. Among the most important are:

1. Good flowability or compactibility to allow the sand to move against the pattern under compacting forces;

2. Good physical strength after compaction to permit the mold to retain its shape after removal of the pattern and during casting;
3. Dimensional stability during the casting process;
4. Good internal cohesion of the sand grains and poor adhesion of the sand grains to the cast article; and
5. Good collapsibility after casting to facilitate shakeout. There are, of course, subsidiary properties which are related to these properties, including compressive strength, permeability, compactibility, mold hardness, green shear, deformation, peel, and the like. In general, a green molding sand typically has properties within the following ranges:

| | | | |
|---|---|---|---|
| Green Compression Strength | 4 | - | 40 psi |
| Green Shear Strength | 0.5 | - | 10 psi |
| Deformation | 0.005 | - | 0.04 in/in |
| Permeability | 6.5 | - | 400 |
| Dry Compression Strength | 50 | - | $200^+$ psi |
| Compactibility | 35 | - | 65% |

If the deformation or compactibility is too low, the green molding sand is too brittle and cannot withstand handling and pattern removal, while if the deformation is too high, dimensional accuracy cannot be maintained, and the mold, especially one of large mass, e.g., 100 pounds or more, may deform under its own weight. If both green strength and deformation are too high, the sand cannot be readily formed and compacted with existing technology. If permeability is less than 6.5, the vapors generated during casting cannot dissipate rapidly enough, and the mold can rupture from gas pressure and molten metal can be ejected out of the sprues. If, on the other hand, the permeability is too high, the molten metal will not be retained in the mold cavity, but will penetrate the voids of the sand. Finally, if the dry strength is too low the sand cannot withstand the erosive effect of the flowing molten metal during casting, while if the dry strength is too high the casting may crack upon solidification.

In general, foundry green molding sands consisting solely of sand, clay and water do not possess an optimum balance of properties. For this reason, a variety of additives have been employed in an effort to improve the properties of green molding sands. Typically these additives are organic materials which are used as facing agents, expansion control agents and the like. In most cases these organic additives are useful in improving only one property of the green sand and thus two or more additives may be required. In addition, an additive employed to improve one property frequently has an adverse effect on another property of the green sand mold. For example, sea coal or bituminous coal has been used as a facing agent, and while it does prevent burn-on, it has been found that increased amounts of clay and water are necessary to restore desirable physical properties possessed by the unmodified green sand.

Green molding sands may be referred to as "soft sands", because they remain plastic and re-formable throughout the mold forming procedure and, in part, during the casting operation. Such molding sands are quite distinct from other molding sands, which may be referred to as "hard sands". These "hard sands", although plastic at the beginning of the mold forming procedure, are hardened and become rigid prior to the casting operation. Hard sands are employed, for example, in investment molding processes, and in forming cores and molds made of resin-bonded sands, or sands formed of sodium silicate or phosphates, or baked drying oil sands. Such hardened sands have compression strengths of the order of 80 to 300 psi or higher. In contrast, green molding sands have compression strengths of the order of about 4 to about 40 psi, and preferably about 12 to about 30 psi.

Green molding sands also may be distinguished from "hard sands" because they are readily recycled, it being necessary only to replace temper water and, if desired, organic or other additives lost during the casting process. In contrast, hard sands can be reclaimed only by removal of all materials except for the refractory grains, and complete replacement of the bonding material. As a consequence, hard sands commonly are discarded after one use.

Because of their quite different composition and mode of use, the problems encountered in green sand casting procedures differ greatly from those of hard sand casting. One such problem is that of control of the amount of temper water to achieve adequate bond strength during both the forming and the casting steps. Slight changes in the amount of water in a green molding sand greatly affect the mechanical properties of the sand. In particular, the dry strength and the hot strength of a green molding sand depend upon the moisture of the sand at compaction; the lower the moisture content, the lower the hot and dry strengths of the sand. For example, a given percentage change in the amount of water has over five times the effect on sand strength as a similar percentage change in the amount of clay or other commonly employed green sand additive.

The problem of controlling moisture levels is compounded by a condition known as "hot green molding sand". Obviously, the sand is heated during the casting process, and unless sufficient time is allowed to elapse to allow the sand to cool to ambient temperature before re-use, the temperature of the sand increases. When the temperature of the sand reaches a temperature of from about 100 to about 160° F., its physical and working properties are materially altered, making mold formation more difficult and causing casting defects. Thus, in mold formation, hot green sand sticks to the pattern and is not readily withdrawn from deep pockets. Further, sand chutes and hoppers tend to clog, and non-homogeneous mold structures are obtained as a result of variations in moisture content of the green sand. Casting defects include dirt or sand inclusions on the casting surface, blows and pinholes, erosion defects, and a general deterioration of the surface of the casting.

Without limiting the invention to any particular theory, it is believed that the primary cause of the problems encountered with hot green sand is the rapid evaporation of water from the hot sand, particularly from exposed sand surfaces both in sand transport and from formed molds, and the inability of operating personnel to control moisture content. Changes in the clay-water structure at elevated temperatures may lead to an open or gelled structural condition, which also contributes to the ease of water loss.

This rapid loss of water from hot green sand results in moisture condensing on cooler surfaces, such as the surfaces of hoppers, chutes and patterns. When these surfaces become wet, the grains in the surface layer of sand adhere more strongly to these surfaces than to other sand grains. This adhesion causes sticking in hoppers and chutes and the inability of the sand to be drawn from deep pockets of patterns. Adhesion of sand to the pattern surface leads to a roughened mold surface having exposed sand grains which are precariously attached to other sand grains. Since the surface layer of the sand loses water more rapidly, the dry strength of the bond of these surface grains to other sand grains is weaker than bonds between internal sand grains. Consequently, these exposed sand grains can be loosened by even slight jarring, and when the loosened sand grains fall and collect in the bottom of a mold cavity, they form dirt inclusions in castings made in such a mold.

In an effort to compensate for the rapid evaporation of moisture, the sand has to be prepared at higher than normal moisture levels. When this is done so that the surface sand delivered at a molding station has adequate moisture for mold forming, it has been found that the protected sand in the interior of the sand mass has an excessive moisture content, resulting in the blows and pinhole defects. This is because the excess moisture leads to the formation of excess gas when the heat from the metal enters the molding sand.

Because of the great differences between the moisture content of the surface and the interior sand due to evaporation as the sand is conveyed on belts to the molding station, a non-homogeneous sand mass results when the two are commingled in the flask of the mold. This non-homogeneous moisture condition results in a mold of non-homogeneous physical properties that has greater susceptibility to failure due to casting stress.

Prior Art

Prior to this invention, efforts had been made to control moisture loss from green molding sands, especially synthetic molding sands. Such sands typically contain less moisture than sands made using naturally-bonded sand, and moisture loss is even more critical in them. Accordingly, when these sands became important in the 1930's various materials were tested to retard moisture evaporation. See, e.g. U.S. Patent No. 1,902,419 to Plant et al, and Dunbeck et al, "The Drying Out of Synthetic Sands", a paper presented at the Annual Convention of the American Foundrymen's Association, April 20–24, 1942. Materials which were evaluated were intended to lower the vapor pressure of water, and thereby retard evaporation, or were hygroscopic materials. Halides, e.g. chlorides, of alkali or alkaline earth metals were reported to be of particular benefit. Although evaporation of temper water was retarded, these materials adversely affected physical properties of green sand. Further, during casting the metal chloride is converted to a metal oxide and hydrogen chloride. The hydrogen chloride fumes which are generated present an undesirable health hazard. In addition, the use of chlorides causes "burn-on", or adhesion of sand to the casting. Finally, although these materials do retard moisture loss, they were not intended to, and indeed do not materially overcome the abovenoted problems associated with hot green sand.

Summary of the Invention

It is an object of this invention to improve the physical properties of hot green sand.

It is a further object of this invention to provide an additive for green molding sand which improves the physical properties of hot green sand.

Still another object of this invention is the provision of an additive for green molding sand which imparts to hot green sand workability and physical properties comparable to those of green molding sand at ambient temperature.

These and other objects of the invention which will be apparent from the ensuing specification, are achieved by adding to green molding sand a lithium or magnesium salt of a lower alkanoic acid, including formic acid. Such acids are those containing from 1 to about 6 carbons, including formic acid, acetic acid, propionic acid, butyric acid, hexanoic acid, isobutyric acid, and the like. Acetic acid salts are preferred from the standpoint of economy. The magnesium and lithium salts are comparable in their effect on the properties of green sand, but magnesium is preferred from the standpoint of economy. In addition, at highly elevated temperatures lithium salts act as fluxes for the sand. Hence, they should not be employed in molds intended for casting steel, but they can be employed for casting aluminum.

The amount of the salt additive which is effective for improving the physical properties of hot green molding sand is small, of the order of from about 174 to about 5 weight percent, based upon the weight of the dry sand. The actual amount employed in a given case will depend upon the particular application, including the temperature of the hot green sand, the amount and type of clay binder, and the amount and type of other additives. It has been found, however, that amounts of from about 0.5 to about 1.5 weight percent, based upon the weight of dry sand, are preferred in most cases.

The lithium and/or magnesium salt may be admixed with the green molding sand by any convenient procedure. It is preferred, however, to add the salt as an aqueous solution. This ensures maximum distribution throughout the bulk of the green molding sand. The concentration of the salt in the aqueous solution is in no way critical, provided, however, the solution is not so dilute that excessive moisture will be added to the sand to obtain the desired level of salt in the sand. Solutions containing from about 20 to about 50 weight percent of the salt are readily employed.

The use of the alkanoate salts of lithium and/or magnesium affords several advantages which are totally unexpected in view of the known activity of corresponding halide salts. Although the alkanoate salts are less effective in reducing moisture loss from hot green sand, they impart greatly improved dry compression strength, green or hot tensile strength, green deformation and toughness, in comparison with the corresponding halide (e.g. chloride) salts. Furthermore, because of their organic content, these compounds pyrolize at the mold face during casting, leaving a carbon residue which has some facing action and acts as a barrier against fusion of sand to the casting. No noxious fumes are generated during casting. Finally, the alkanoate salts are less hygroscopic than the chlorides. As a consequence, molding sands containing the alkanoate salts are less likely to gain moisture on storage, especially at conditions of high humidity.

The alkanoate salts may be added to the molding sand in combination with other additives, including facing agents, expansion control agents and the like. If the alkanoate salt is added as an aqueous solution, the other additive should be at least water dispersible, and preferably water soluble. A particularly preferred additive for use in admixture with the alkanoate salt additive of this invention is trihydroxydiphenyl or resinous materials containing trihydroxydiphenyl, such as RM 441, as disclosed in U.S. Patent No. 3,816,145, the disclosure of which is incorporated herein by reference. The trihydroxydiphenyl is employed in the aqueous solution in an amount sufficient to impart improved green sand properties in accordance with the teachings of U.S. Pat. No. 3,816,145. In such a composition the concentration of alkanoate salt will vary from about 5 to about 40 weight percent and the concentration of the trihydroxydiphenyl will vary from about 20 to about 80 weight percent, provided that there be at least 15% water in said composition.

The following examples are illustrative of the present invention. In the examples, a green molding sand was made from 4475 parts by weight of No. 130 McConnellsville sand,* 300 parts by weight of Western bentonite, 75 parts by weight of water and 150 parts by weight of a 50% aqueous solution of the additive to be evaluated. Where the additive was a hydrated salt, e.g. magnesium acetate tetrahydrate, the 50% concentration was on a hydrated salt basis and not the anhydrous basis. Thus, the concentration of salt on an anhydrous basis was lower than 50%, and in the case of magnesium acetate, was 33.2%. In addition, a control sand was prepared from 4475 parts sand, 300 parts Western bentonite and 150 parts water. Each green molding sand composition was produced by adding water and, where employed, the aqueous solution of the additive to the sand, mulling for one minute, adding the Western bentonite, and mulling for 10 minutes. Two minutes before the end of the mulling, the moisture content was checked and the moisture content was adjusted, if necessary, to about 3%. After aging overnight, physical properties of the thus-prepared sand were determined on the sand at ambient temperature and also on the sand after it had been distributed, uniformly heated to 135°-150° F. in a sealed container, then distributed uniformly to a depth of one inch on a surface heated at 140° F. and exposed to the atmosphere for up to 25 minutes to simulate hot sand.

* Typical analysis: AFS Fineness #133; 0.2% on #40 mesh; 0.4% on #50 mesh; 2.4% on #70 mesh; 12.8% on #100 mesh; 29.2% on #140 mesh; 39.4% on #200 mesh; 9.4% on #270 mesh and 6.8% below #270 mesh.

1. Green Tensile Strength — Ambient and hot sand. Determined according to "AFS Foundry Sand Handbook", Sec. 8, page 6, 1963 edition. Reported in psi as the average of three tests.
2. Green Compressive Strength — Ambient sand only. Determined according to "AFS Foundry Sand Handbook", Sec. 8, page 2, 1963 edition. Reported in psi as the average of three tests.
3. Dry Compressive Strength — Ambient and hot sand. Determined according to "AFS Foundry Sand Handbook", Sec. 8, page 4, 1963 edition. Reported in psi as the average of three tests.
4. Green Shear Strength — Ambient sand only. Determined according to "AFS Foundry Sand Handbook", Sec. 8, page 5, 1963 edition. Reported in psi as the average of three tests.
5. Green Permeability — Ambient sand only. Determined according to "AFS Foundry Sand Handbook", Sec. 7, page 9, 1963 edition. Reported in permeability number as the average of three tests.
6. Green Mold Hardness — Ambient sand only. Determined according to "AFS Foundry Sand Handbook", Sec. 9, page 1, 1963 edition. Reported in mold hardness number as the average of three tests.
7. Green Mold Deformation — Ambient sand only. Determined according to "AFS Foundry Sand Handbook", Sec. 16, page 1, 1963 edition. Reported in inches per inch as the average of three tests.

8. Toughness — The product of green compressive strength and green deformation $\times 10^{-3}$.
9. Compactibility — Ambient and hot sand. Determined according to "AFS Foundry Sand Handbook", Sec. 9, page 4, (Rev.-73). Reported in percent.
10. Moisture — Ambient and hot sand. Determined according to the calcium carbide method, "AFS Foundry Sand Handbook", Sec. 6, page 5, 1963 edition.
11. Stick — Hot sand only. Sand at 150° F. (65.6° C.) is riddled through a #6 sieve into a bronze clay wash base having a cylindrical cavity 3⅝ inches in diameter and 1⅛ inches deep at ambient temperature (about 70° F. (21.1° C.). Excess sand is struck off, the sand is allowed to stand for 3 minutes and then the mold is inverted and rapped 4 times to allow the sand to drop out. The weight of the sand, in grams, adhering to the surface of the cavity is determined by weight in grams.

EXAMPLES 1 and 2

Employing procedures outlined above, magnesium acetate and lithium acetate were tested as green sand additives. The data obtained from these two experiments are summarized in Table I, below, together with data from a control run in the absence of additive.

TABLE I

Evaluation of Lithium and Magnesium Acetates

| | Control Run | Example 1 Magnesium Acetate+ | Example 2 Lithium Acetate+ |
|---|---|---|---|
| Additive | | | |
| Conc. anhydrous basis, % | — | 33.2 | 32.4 |
| Green Sand Properties (Ambient) | | | |
| Tensile Strength | 1.66 | 1.34 | 1.24 |
| Compressive Strength | 11.5 | 10.3 | 9.4 |
| Deformation $\times 10^{-3}$ | 12.5 | 18.0 | 17.0 |
| Toughness | 144 | 185 | 160 |
| Shear Strength | 2.7 | 2.8 | 2.5 |
| Permeability | 53.0 | 55.8 | 53.5 |
| Mold Hardness | 90.0 | 88.0 | 87.0 |
| Compactibility | 63.5 | 66.0 | 65.0 |

TABLE I-continued

Evaluation of Lithium and Magnesium Acetates

| | Control Run | Example 1 Magnesium Acetate+ | Example 2 Lithium Acetate+ |
|---|---|---|---|
| Dry Compressive Strength (Ambient) | 137 | 278 | 277 |
| Hot Sand Properties | | | |
| Hot Compactibility | | | |
| 0 min. exposure | 57.5 | 63.0 | 62.0 |
| 5 min. exposure | 39.0 | 57.0 | 58.5 |
| 10 min. exposure | 40.0 | 56.5 | 57.0 |
| 15 min. exposure | 37.0 | 55.0 | 55.0 |
| 20 min. exposure | 38.0 | 52.0 | 54.0 |
| 25 min. exposure | 38.0 | 51.0 | 50.0 |
| Dry Compressive Strength | | | |
| 0 min. exposure | 81.0 | 207 | 232 |
| 5 min. exposure | 37.0 | 158 | 180 |
| 10 min. exposure | 38.0 | 150 | 164 |
| 15 min. exposure | 39.0 | 146 | 160 |
| 20 min. exposure | 31.0 | 131 | 162 |
| 25 min. exposure | 37.0 | 124 | 130 |
| Moisture | | | |
| Initial | 3.1 | 3.1 | 3.0 |
| Final | 1.75 | 1.85 | 1.95 |
| Hot Green Tensile Strength | 1.44* | 1.10 | 0.97 |
| Stick Test | 3** | 0.15 | 0.2 |

*Average of 6 tests.
**After two sets of 4 raps.
+Magnesium acetate as $MgAc \cdot 4H_2O$; lithium acetate as $LiAc \cdot 2H_2O$.

As is evident from the foregoing, both magnesium acetate and lithium acetate materially improved hot sand compactibility and dry compressive strength and greatly reduced the amount of sand sticking to the mold in the stick test. This was accomplished without any material adverse affect on green sand or dry sand properties at ambient temperature. Indeed, the additives of this invention materially increased toughness and the dry compressive strength of the green molding sand.

COMPARISON EXAMPLES A-E

The above-described test procedures were repeated, using various metal chlorides as additives. The data from these tests are summarized in Table II, together with corresponding data for Examples 1 and 2 for purposes of comparison.

TABLE II

Comparison of Lithium and Magnesium Acetates with Metal Chlorides

| | Control Run | 1 MgAc* | A $MgCl_2$+ | B $CaCl_2$+ | 2 LiAc* | C LiCl | D KCl | E NaCl |
|---|---|---|---|---|---|---|---|---|
| Additive | — | | | | | | | |
| Concentration, anhydrous basis, % | 1.66 | 33.2 | 23.4 | 37.8 | 32.4 | 50 | 50 | 50 |
| Green Sand Properties (Ambient) | | | | | | | | |
| Tensile Strength | 1.66 | 1.34 | 1.13 | 0.89 | 1.24 | 0.91 | 0.66 | 0.94 |
| Compactibility | 63.5 | 66.0 | 63.0 | 62.0 | 65.0 | 55.0 | 52.5 | 56.0 |
| Dry Compressive Strength (Ambient) | 137 | 278 | 90.0 | 85.0 | 277 | 38.0 | 30.0 | 75.0 |
| Hot Sand Properties | | | | | | | | |
| Hot Compactibility | | | | | | | | |
| 0 min. exposure | 57.5 | 63.0 | 61.5 | 57.0 | 62.0 | 50.0 | 41.5 | 49.0 |
| 5 min. exposure | 39.0 | 57.0 | 58.0 | 57.0 | 58.5 | 47.0 | 30.0 | 37.5 |
| 10 min. exposure | 40.0 | 56.5 | 54.0 | 56.0 | 57.0 | 46.0 | 29.5 | 33.5 |
| 15 min. exposure | 37.0 | 55.0 | 58.5 | 55.0 | 55.0 | 47.0 | 27.0 | 35.0 |
| 20 min. exposure | 38.0 | 52.0 | 57.0 | 54.0 | 54.0 | 47.0 | 26.5 | 32.0 |
| 25 min. exposure | 38.0 | 51.0 | 54.0 | 51.0 | 50.0 | 47.0 | 25.0 | 28.5 |
| Dry Compressive Strength | | | | | | | | |
| 0 min. exposure | 81 | 207 | 53 | 58 | 232 | 40 | — | 29 |
| 5 min. exposure | 37 | 158 | 51 | 73 | 180 | 40 | 32 | 35 |
| 10 min. exposure | 38 | 150 | 50 | 78 | 164 | 43 | 33 | 34 |
| 15 min. exposure | 39 | 146 | 50 | 64 | 160 | 42 | 40 | 33 |
| 20 min. exposure | 31 | 131 | 50 | 60 | 162 | 44 | 32 | 33 |
| 25 min. exposure | 37 | 124 | 48 | 58 | 130 | 43 | 30 | 27 |
| Moisture | | | | | | | | |
| Initial | 3.1 | 3.1 | 3.1 | 3.1 | 3.0 | 3.1 | 3.1 | 3.0 |
| Final | 1.75 | 1.85 | 2.1 | 2.1 | 1.95 | 2.75 | 1.7 | 1.7 |
| Hot Green Tensile Strength | 1.44 | 1.10 | 0.86 | 0.75 | 0.97 | 0.64 | 0.78 | 0.98 |

TABLE II-continued

| | Comparison of Lithium and Magnesium Acetates with Metal Chlorides | | | | | | | |
|---|---|---|---|---|---|---|---|---|
| | | Examples | | | | | | |
| | Control Run | 1 MgAc* | A $MgCl_2$+ | B $CaCl_2$+ | 2 LiAc* | C LiCl | D KCl | E NaCl |
| Stick Test | 3.0 | 0.15 | 0.1 | 0.1 | 0.2 | 0 | 0.3 | 0.1 |

*MgAc = magnesium acetate; LiAc - lithium acetate.
+$MgCl_2$ as $MgCl_2 \cdot 6H_2O$; $CaCl_2$ as $CaCl_2 \cdot 2H_2O$.

From the data set forth in Table II it can be seen that the metal acetate additives of this invention are superior to the corresponding metal chlorides or other alkali and alkaline earth metal chlorides as additives to green molding sand. Thus, the chlorides materially reduced green tensile strength and dry compressive strength of the green molding sand. Furthermore, the chlorides afforded little or no improvement in dry compressive strength and greatly reduced green tensile strength of the hot molding sand. Of particular interest is the poor performance of lithium chloride despite the fact it was vastly superior to all other additives in its ability to retard moisture loss.

COMPARISON EXAMPLES F-K

Employing similar procedures, acetates of metals other than lithium and magnesium were tested. The results of these tests are summarized in Table III, together with the results of Examples 1 and 2 for purpose of comparison.

TABLE III

| | Comparison of Lithium and Magnesium Acetates with Other Metal Acetates | | | | | | | |
|---|---|---|---|---|---|---|---|---|
| | | Example | | | | | | |
| | Control Run | 1 MgAc | F CaAc+ | G BaAc | H ZnAc+ | 2 LiAc | J KAc | K NaAc+ |
| Additive | — | | | | | | | |
| Concentration, anhydrous basis, % | | 33.2 | 44.8 | 50 | 41.7 | 32.4 | 50 | 30.2 |
| Green Sand Properties | | | | | | | | |
| Tensile Strength | 1.66 | 1.34 | 1.60 | 1.42 | 1.46 | 1.24 | 0.61 | 1.11 |
| Compactibility | 63.5 | 66 | 65 | 62 | 62 | 65 | 54 | 63 |
| Dry Compressive Strength | 137 | 278 | 277 | 222 | 223 | 277 | 70 | 128 |
| Hot Sand Properties | | | | | | | | |
| Hot Compactibility | | | | | | | | |
| 0 min. exposure | 57.5 | 63.0 | 59.0 | 58.0 | 61.0 | 62.0 | 51.0 | 59.0 |
| 5 min. exposure | 39.0 | 57.0 | 41.0 | 39.5 | 45.0 | 58.5 | 46.0 | 53.0 |
| 10 min. exposure | 40.0 | 56.5 | 43.5 | 37.5 | 44.5 | 57.0 | 44.0 | 49.0 |
| 15 min. exposure | 37.0 | 55.0 | 41.0 | 36.5 | 45.0 | 55.0 | 40.0 | 48.0 |
| 20 min. exposure | 38.0 | 52.0 | 41.0 | 35.0 | 44.5 | 54.0 | 38.0 | 52.0 |
| 25 min. exposure | 38.0 | 51.0 | 43.0 | 33.0 | 41.0 | 50.0 | 35.0 | 38.0 |
| Dry Compressive Strength | | | | | | | | |
| 0 min. exposure | 81 | 207 | 179 | 146 | 169 | 232 | 59 | 104 |
| 5 min. exposure | 37 | 158 | 83 | 95 | 65 | 180 | 56 | 74 |
| 10 min. exposure | 38 | 150 | 98 | 86 | 77 | 164 | 52 | 71 |
| 15 min. exposure | 39 | 146 | 86 | 80 | 79 | 160 | 46 | 61 |
| 20 min. exposure | 31 | 131 | 79 | 71 | 84 | 162 | 50 | 59 |
| 25 min. exposure | 37 | 124 | 80 | 63 | 89 | 130 | 51 | 50 |
| Moisture | | | | | | | | |
| Initial | 3.1 | 3.1 | 3.1 | 3.15 | 2.95 | 3.0 | 3.1 | 3.1 |
| Final | 1.75 | 1.85 | 1.8 | 1.6 | 1.95 | 1.95 | 2.0 | 1.6 |
| Stick Test | 3 | 0.15 | 0.4 | 0.7 | 0.1 | 0.2 | 0.2 | 0.1 |

+CaAc as $CaAc \cdot H_2O$; ZnAc as $ZnAc \cdot 2H_2O$; NaAc as $NaAc \cdot 3H_2O$.

From Table III it can be seen that, of the various acetate salts tested, only those of magnesium and lithium materially increased hot sand properties. The other acetates had little or no beneficial effect on either hot sand compactibility or hot sand dry compressive strength. In particular, potassium acetate, which had been evaluated by Dunbeck as a moisture retention additive for synthetic sands, and was reported as being inferior to lithium chloride, was of no significant value except in the stick test.

In the foregoing examples, only single compounds have been disclosed. It is within the scope of this invention that mixtures of two or more lithium or calcium salts may be employed; however, no particular advantage is achieved by the use of such mixtures. Magnesium acetate is especially preferred. This material, when dissolved in water, tends to form a skin or crust on the surface of the solution on exposure to the atmosphere. This skin tends to retard evaporation of water from the solution under the skin. It is possible that this property accounts for the outstanding superiority of magnesium acetate as an additive for hot green molding sand.

What is claimed is:

1. A method for imparting improved hot sand properties to a green molding sand consisting essentially of sand, clay as a binder and moisture which comprises admixing said sand, clay and moisture with at least one salt selected from the group consisting of a lithium or a magnesium salt of a lower alkanoic acid in an amount sufficient to impart improved hot sand properties to said green molding sand.

2. A method according to claim 1 wherein said salt is an acetate.

3. A method according to claim 2 wherein the amount of said salt is from about ¼ to about 5 weight percent, based upon the weight of said sand.

4. A method according to claim 2 wherein said salt is lithium acetate.

5. A method according to claim 2 wherein said salt is magnesium acetate.

6. A green molding sand consisting essentially of a mixture of sand, clay as a binder, moisture and at least one salt selected from the group consisting of a lithium or magnesium salt of a lower alkanoic acid in an amount sufficient to impart improved hot sand properties to said green molding sand.

7. A method according to claim 6 wherein said salt is an acetate.

8. A method according to claim 7 wherein the amount of said salt is from about ¼ to about 5 weight percent, based upon the weight of said sand.

9. A method according to claim 7 wherein said salt is lithium acetate.

10. A method according to claim 7 wherein said salt is magnesium acetate.

11. A composition adapted to improve properties of green molding sand comprising an aqueous solution of at least one salt selected from the group consisting of a lithium or a magnesium salt of a lower alkanoic acid and a second water dispersible or water soluble green molding sand additive for improving the properties of green molding sand.

12. A composition according to claim 11 wherein said salt is lithium acetate and/or a magnesium acetate.

13. A composition according to claim 12 wherein said second additive is trihydroxydiphenyl.

14. A composition according to claim 13 wherein said salt is present in an amount of from about 5 to about 40 weight percent and said trihydroxydiphenyl is present in an amount of from about 20 to about 80 weight percent, provided that there is at least 15 weight percent water in said composition.

15. A composition according to claim 14 wherein said salt is lithium acetate.

16. A composition according to claim 14 wherein said salt is magnesium acetate.

* * * * *

UNITED STATES PATENT AND TRADEMARK OFFICE

CERTIFICATE OF CORRECTION

PATENT NO. : 4,131,476

DATED : December 26, 1978

INVENTOR(S) : Ronald E. Melcher and Frederick W. Schaefer

It is certified that error appears in the above-identified patent and that said Letters Patent are hereby corrected as shown below:

Column 5, line 18, "174" should read -- 1/4 --.

Signed and Sealed this

*Third* Day of *April 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,131,476

DATED : December 26, 1978

INVENTOR(S) : Ronald E. Melcher and Frederick W. Schaefer

It is certified that error appears in the above-identified patent and that said Letters Patent are hereby corrected as shown below:

Column 10, line 13, "calcium" should read --magnesium--.

Column 11, line 7, "method" should read --green molding sand--.

line 9, "method" should read --green molding sand--.

line 12, "method" should read --green molding sand--.

line 14, "method" should read --green molding sand--.

Signed and Sealed this

*Ninth* Day of *December 1980*

[SEAL]

*Attest:*

SIDNEY A. DIAMOND

*Attesting Officer*

*Commissioner of Patents and Trademarks*